US007059015B2

(12) United States Patent
Hamline et al.

(10) Patent No.: US 7,059,015 B2
(45) Date of Patent: Jun. 13, 2006

(54) TOOL MOUNTING ASSEMBLY FOR A SURFACE MAINTENANCE MACHINE

(75) Inventors: Anthony John Hamline, St. Paul, MN (US); Robert Allan Geyer, Green Valley, AZ (US); Richard Allen Nelson, Big Lake, MN (US); Terence Alan Peterson, Plymouth, MN (US)

(73) Assignee: Tennant Company, Minneapolis, MN (US)

( * ) Notice: Subject to any disclaimer, the term of this patent is extended or adjusted under 35 U.S.C. 154(b) by 418 days.

(21) Appl. No.: 10/394,939

(22) Filed: Mar. 21, 2003

(65) Prior Publication Data

US 2004/0025288 A1 Feb. 12, 2004

Related U.S. Application Data

(60) Provisional application No. 60/366,486, filed on Mar. 21, 2002.

(51) Int. Cl.
*E01H 1/08* (2006.01)

(52) U.S. Cl. ..... 15/401; 15/49.1; 15/78; 15/320; 15/340.3

(58) Field of Classification Search ..... 15/49.1, 15/50.1, 78, 87, 320, 340.1, 340.2, 340.3, 15/340.4, 401; 172/38, 91, 96, 794, 816; 451/350–353

See application file for complete search history.

(56) References Cited

U.S. PATENT DOCUMENTS

| | | | | |
|---|---|---|---|---|
| 3,939,518 | A * | 2/1976 | Whitney et al. | 15/98 |
| 4,006,506 | A * | 2/1977 | Burgoon | 15/50.1 |
| 4,492,002 | A | 1/1985 | Waldhauser et al. | 15/320 |
| 5,265,300 | A | 11/1993 | O'Hara et al. | 15/49.1 |
| 5,377,382 | A * | 1/1995 | Bores et al. | 15/340.1 |
| 5,454,138 | A | 10/1995 | Mondigo et al. | 15/354 |
| 5,455,985 | A | 10/1995 | Hamline et al. | 15/401 |
| 5,623,743 | A | 4/1997 | Burgoon et al. | 15/320 |
| 6,108,859 | A | 8/2000 | Burgoon | 15/320 |
| 6,418,476 | B1 * | 7/2002 | Luciani | 709/238 |
| 6,519,808 | B1 * | 2/2003 | Legatt et al. | 15/401 |
| 6,602,018 | B1 * | 8/2003 | Feeny et al. | 403/227 |
| 2002/0073494 | A1 * | 6/2002 | Stuchlik | 15/49.1 |

FOREIGN PATENT DOCUMENTS

| | | |
|---|---|---|
| DE | 2241901 | * 3/1974 |
| EP | 1061180 | * 12/2000 |

* cited by examiner

*Primary Examiner*—Terrence R. Till
(74) *Attorney, Agent, or Firm*—Fulbright & Jaworski L.L.P.

(57) ABSTRACT

A squeegee mount and assembly which cooperate to permit both pivotal and linear motion of the squeegee assembly relative to the machine frame. To avoid contact with a stationary object, the squeegee assembly can be both pivoted and linearly moved relative to the surface maintenance machine, thereby preventing damage to the squeegee assembly and/or the surface maintenance machine. The squeegee mounting assembly includes a mounting arm, a subframe, a return spring coupled between the subframe and the frame, and a stop. A squeegee assembly comprised of a squeegee blade, an arcuate squeegee blade holder, and a link which couples the blade holder to the squeegee mounting assembly. A guard rail is also coupled to one end of the blade holder and rotatively coupled along another end to the frame.

17 Claims, 5 Drawing Sheets

TOOL MOUNTING ASSEMBLY FOR A SURFACE MAINTENANCE MACHINE

PRIOR HISTORY

This application claims priority from U.S. Provisional Application No. 60/366,486 filed on Mar. 21, 2002, and hereby incorporated by reference in its entirety.

FIELD OF THE INVENTION

The invention relates to a tool mounting assembly for a surface maintenance machine, and more particularly to a squeegee mounting assembly having a plurality of articulation modes during operation.

BACKGROUND, SUMMARY, AND DESCRIPTION OF THE PRESENT INVENTION

Surface maintenance machines such as scrubbers and sweeper/scrubbers are well known. Typically, these machines travel over a surface and either cleans or puts a finish over the surface. The undersides of these machines typically include a spray assembly, a rotating brush assembly, a squeegee assembly, and a vacuum assembly. The spray assembly will typically spray a fluid onto a surface and the brush assembly scrubs the surface with the sprayed fluid. Once the brush assembly passes over the surface, the squeegee assembly gathers excess fluid remaining on the surface, so that the vacuum assembly is better able to collect it. Typically, the vacuum assembly communicates with a vacuum chamber defined within the squeegee assembly to lift any excess fluid from the surface. As such, the surface maintenance machines are typically able to clean a surface while avoiding excessive fluid buildup on the surface.

Typically, the squeegee assembly includes a squeegee supporting member of generally arcuate or shallow v-shaped configuration with spaced squeegee blades depending therefrom. The squeegee blades scrape a surface and pools excess fluid lying thereon, allowing the fluid to be more readily vacuumed from the surface. In order to efficiently pool fluid from a surface, the squeegee assembly must typically be longer than the width of the path of the scrub brushes. Often, this necessitates having a squeegee assembly which extends beyond the framework of the surface maintenance machine. Consequently, the ends of the squeegee assembly tend to be exposed at the sides of the machine, leaving them potentially vulnerable to stationary objects which might be encountered during the machine operation. A collision between an end of a squeegee assembly and a stationary object could result in substantial damage to the squeegee assembly.

A number of squeegee mounting assembly structures were developed to alleviate problems with collisions, some of these include U.S. Pat. Nos. 4,492,002; 4,854,005; 5,265,300; 5,454,138; 5,455,985; 5,623,743; and 6,108,859, each of which being incorporated by reference herein. These structures typically permit only a single angular articulation (typically permitting pivoting motion) between the squeegee assembly and the surface maintenance machine. One such example of a single articulation mounting assembly is disclosed in U.S. Pat. No. 4,854,005, wherein the squeegee is pivotally coupled to the machine.

However, due to the shape and size of common squeegee blade holders, known single articulation squeegee mounting structures typically have a limited range of motion, and may not allow the end of the squeegee to fully retract within the framework of the machine. As such, the squeegee assembly is still typically subject to damage from collision. Consequently, there is a need for a scrubbing machine with an improved squeegee mounting assembly and squeegee assembly with cooperate to fully retract the squeegee assembly within the framework of a surface maintenance machine.

SUMMARY

In accordance with the above, the present invention provides a novel means of mounting and articulating a squeegee assembly which permits a plurality of operational articulations between the squeegee and the surface maintenance machine. In one embodiment, the subject invention includes a squeegee mounting assembly and a squeegee assembly which cooperate to permit both pivotal and linear motion of the squeegee assembly relative to the machine frame. To avoid contact with a stationary object, the squeegee assembly can be both pivoted and linearly moved to fully retract it within the boundary of a surface maintenance machine, thereby preventing damage to the squeegee assembly and/or the surface maintenance machine.

In one embodiment, the subject invention includes a squeegee mounting assembly slidably coupled to the frame of a surface maintenance machine to allow transversal movement of the squeegee mounting assembly relative to the frame. The squeegee mounting assembly includes a mounting arm, a subframe, a return spring coupled between the subframe and the frame, and a stop.

In one embodiment, the subject invention includes a squeegee assembly comprised of a squeegee blade, an arcuate squeegee blade holder, and a link which couples the blade holder to the squeegee mounting assembly. A guard rail is also coupled to one end of the blade holder and rotatively coupled along another end to the frame.

In one embodiment, the squeegee assembly achieves a first degree of articulation by pivoting relative to the subframe and frame. Once an object or a wall contacts the guard rail, the guard rail is forced to pivot inwardly relative to the frame, causing the blade holder to also pivot inwardly relative to the frame. This pivoting movement is limited by the stop located on the squeegee mount assembly.

After the squeegee assembly engages the stop, the squeegee assembly achieves a second degree of articulation by causing the squeegee mount assembly to move transversally with respect to the frame. A sufficient force applied to the guard, overcomes the bias provided by the return spring and causes the mount to move transversally with respect to the frame.

As a result of this first and second degree of articulation, the squeegee assembly can be moved or "retracted" substantially within the frame of a surface maintenance machine. This allows the squeegee assembly to better avoid damaging collisions with a wall or other obstacles. As a further result, a surface maintenance machine having the present invention can also be operated significantly closer to a wall structure or an obstruction. Other features and advantages of the present invention will become apparent to those of ordinary skill in the relevant arts upon review of the following detailed drawings and description of preferred embodiments.

BRIEF DESCRIPTION OF TO THE DRAWINGS

Preferred embodiments of the invention will be described in detail hereinafter with reference to the accompanying drawings, in which like reference numeral refer to like elements throughout, wherein.

DETAILED DESCRIPTION OF PREFERRED EMBODIMENTS

The present invention is an apparatus and method of coupling a surface maintenance tool to a surface maintenance machine or other similar apparatus. For the purposes of explanation only, the subject invention is described and shown as being configured to mount a squeegee assembly to a surface maintenance machine. It will be readily apparent to one skilled in the art that other forms of surface maintenance tools can be utilized with the present invention.

Figure 1:
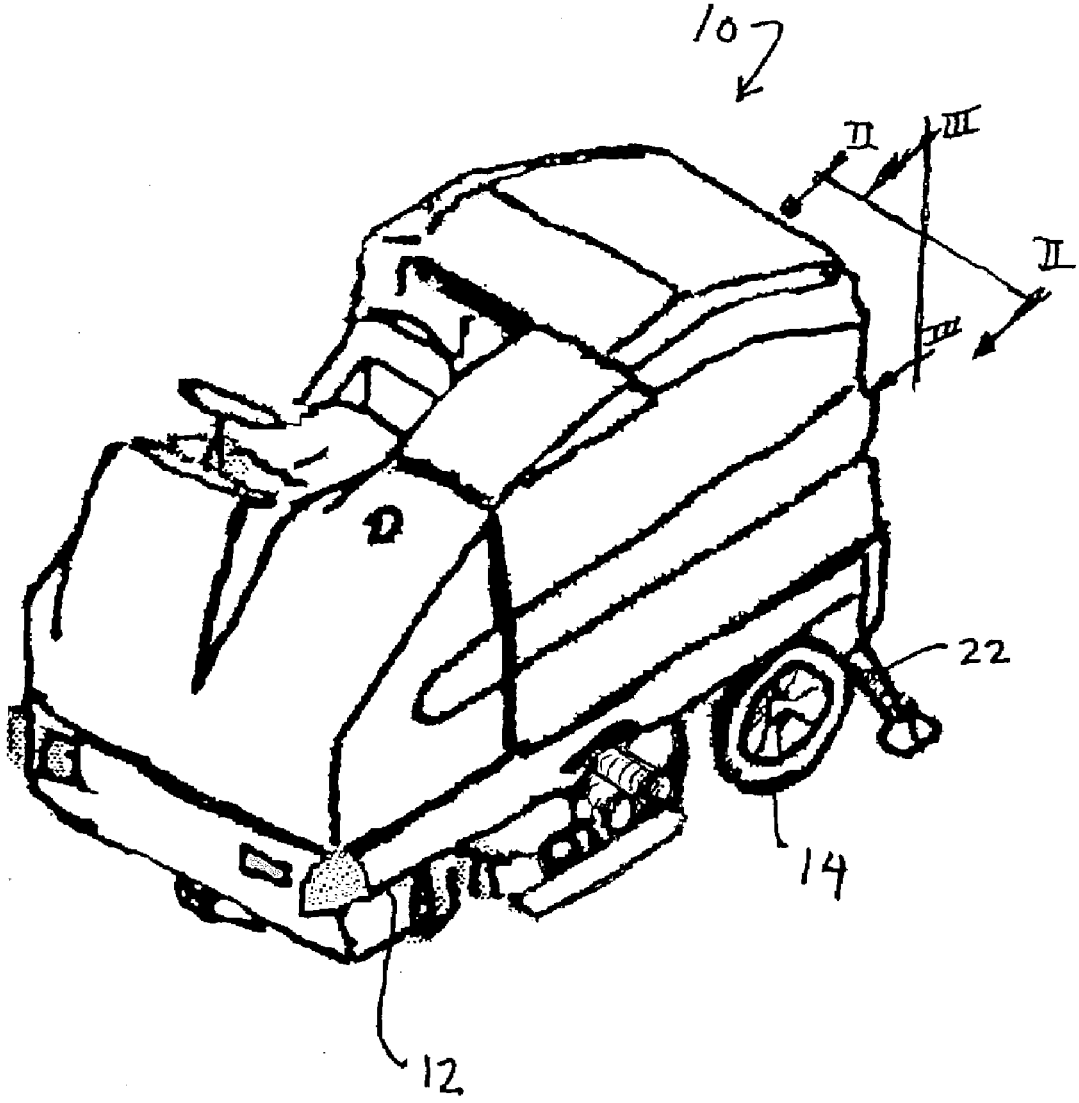
FIG. 1 is a perspective illustration of an embodiment of a surface maintenance machine according to the present invention.

Referring to FIG. 1, one embodiment of a riding-type surface maintenance machine 10 configured to use the present invention is shown. Such a surface maintenance machine 10 is typically used for sweeping and/or scrubbing floors in factories, warehouses, and other industrial or commercial establishments. The surface maintenance machine 10 has a frame 12, and is supported on a plurality of front and rear wheels 14. One embodiment of a surface maintenance machine is disclosed in U.S. Pat. No. 5,455,985, and incorporated herein by reference in its entirety.

Figure 2:
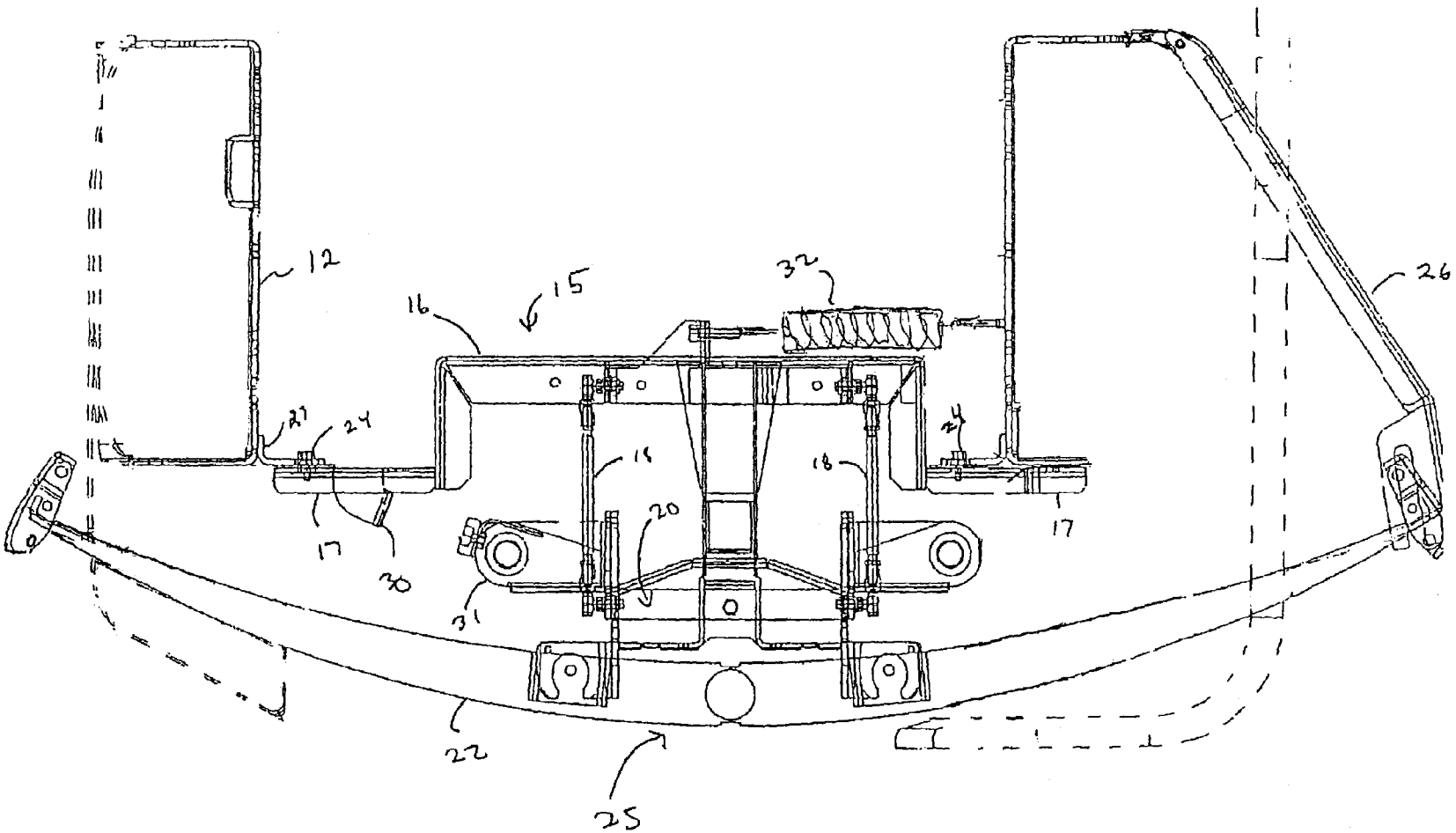
FIG. 2 is an enlarged partial section of the surface maintenance machine of FIG. 1 taken substantially along line II—II.
Figure 5:
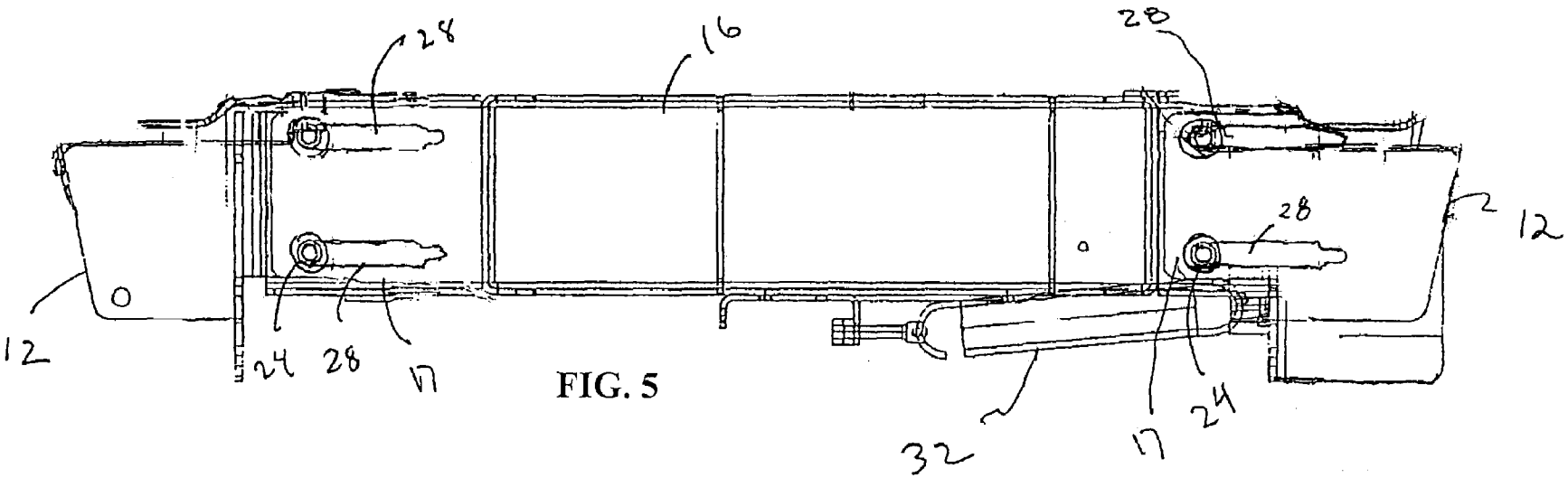
FIG. 5 is a enlarged partial section of the surface maintenance machine of FIG. 1 taken substantially along line III—III.

Referring to FIGS. 2 and 5, in one embodiment, the subject invention includes a squeegee mount assembly 15 coupled to the frame 12 of the surfaced maintenance machine 10. The squeegee mount assembly 15 includes subframe 16 and a pair of mounting arms 17. A plurality of fasteners 24 movably couple the mounting arms 17 to the frame 12. The fasteners 24 are in generally fixed engagement to the frame 12 while being slidingly engaged to a plurality of transversely directed slots 28 located on the mounting arms 17. Thus, the squeegee mount assembly 15 is able to move transversely relative to the frame 12.

Figure 6:
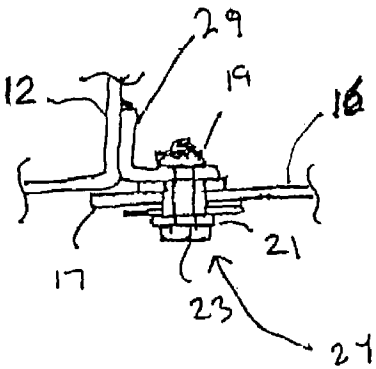
FIG. 6 is a top plan view of a sliding joint in according to the present invention.

As shown in FIG. 6, in one embodiment, the fastener 24 includes a bolt 23, a washer 21, and a nut 19. Bolt 23 extends through a locating arm 29 connected to the frame 12 and through the slots 28. The extended portion of bolt 23 then engages washer 21 and the nut 23 along one end. It can be readily appreciated by one skilled in the art that a number of various fasteners may be generally substituted for the disclosed embodiment without adding any novelty to the subject invention. Furthermore, the disclosed means for slidingly coupling the mount assembly 15 to the frame 12 may also be readily modified. The use of pneumatic or hydraulic cylinders, springs, and locating surfaces to enable transverse movement of the squeegee mount assembly 15 relative to the frame 12 has also been contemplated.

In one embodiment, the squeegee mount assembly 15 is biased to a first position by a return spring 32 coupling the subframe 16 to the frame 12. A stop 30 depends from the mounting arm 17. The stop 30 is configured on the mounting arm 17 to receive a force and then directionally translate that force to oppose the biasing effect of the return spring 32.

Referring to FIGS. 2, 3, 4, and 5, in one embodiment, the subject invention includes a squeegee assembly 25 coupled to the squeegee mount assembly 15. The squeegee assembly 25 includes movable links 18, a connecting structure 20, a squeegee blade holder 22, and a plurality of squeegee blades (not shown) depending from the blade holder 22. A guard rail 26 is pivotally connected to the frame 12 at one end and engages the blade holder 22 at its other end. The guard rail 26 may extend transversally beyond the frame 12.

In one embodiment, each of the movable links 18 includes a pair of ball joints for pivotally coupling each link 18 to the subframe on one end and to the connecting structure 20 on the other. In one embodiment, four generally parallel links 18 may be provided. The blade holder 22 and links 18 are connected together through connecting structure 20. One exemplary connecting structure is disclosed in Assignee's U.S. Pat. No. 6,602,018, incorporated by reference herein. Connecting structure 20 includes s top arm 31, positioned to engage stop 30 when the squeegee assembly reaches a predetermined pivot position relative to the relative to the squeegee mount assembly 15.

Operation

Upon contact with a wall surface or other obstacle, guard rail 26 transfers a force to the blade holder 22 which causes it to move inwardly towards the confines of the frame 12 and away from the wall surface or other obstacle. Depending on the level of force, blade holder 22 as described hereinafter is biased into one or more articulation modes.

FIG. 2 illustrates the blade holder 22 in its "normal" or "neutral" operation position relative to the subframe 16 and frame 12 of the surface cleaning machine 10. As illustrated, one end of the blade holder 22 extends past the side boundary 40 of machine 10. This extended portion is protected by guard rail 26.

Figure 3:
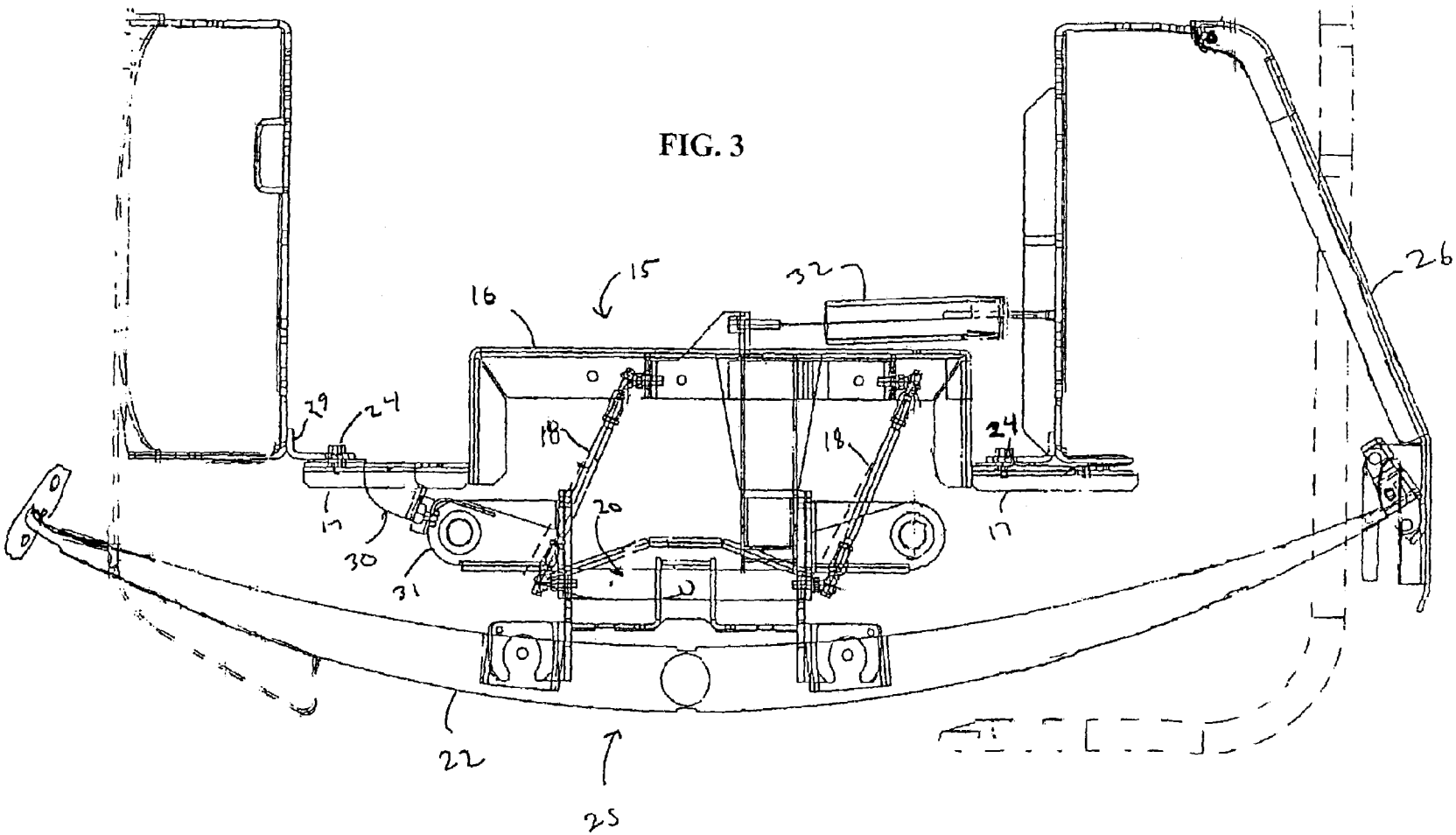
FIG. 3 is an enlarged partial section of the surface maintenance machine of FIG. 1 taken substantially along line II—II with the surface maintenance machine in an engaged position with an obstacle.

FIG. 3 illustrates blade holder 22 in another orientation relative to the subframe 16 and frame 12. Blade holder 22 is displaced inwardly relative to the frame 12 by a force transferred through guard rail 26, such as through guard rail 26 being in contact with a wall surface or other obstacle. Relative to the neutral position of FIG. 2, blade holder 22 has pivoted with respect to the subframe 16. FIG. 3 further illustrates the stop 30 and the stop arm 31 limiting further pivotal movement of the connecting structure 20 relative to the subframe 16. A first mode of articulation can thus be defined a rotational or pivotal articulation wherein the blade holder 22 has pivoted relative to the subframe 16.

Figure 4:
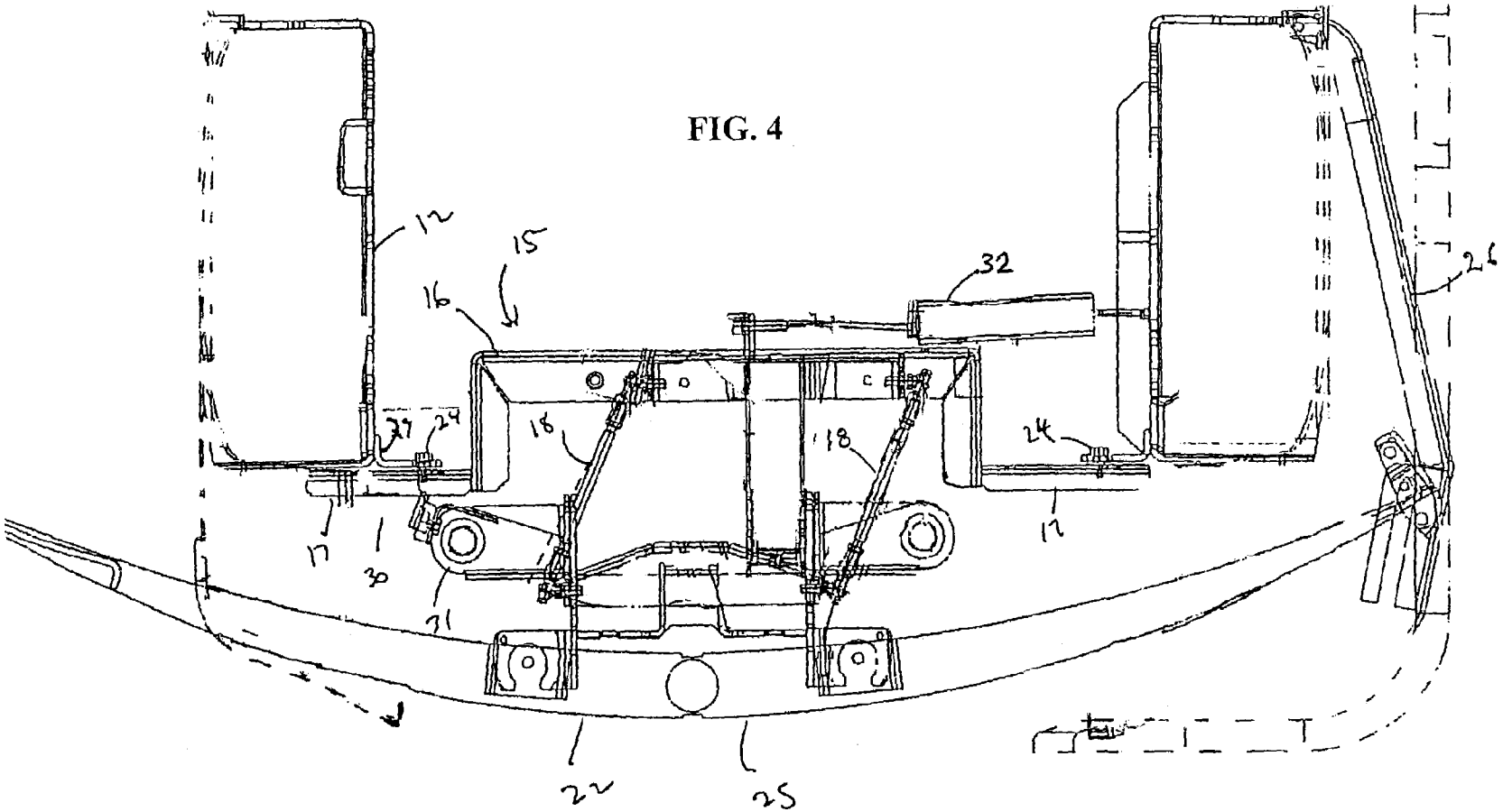
FIG. 4 is an enlarged partial section of the surface maintenance machine of FIG. 1 taken substantially along line II—II with the surface maintenance machine in a fully engaged position with an obstacle.

FIG. 4 illustrates the blade holder 22 in another orientation relative to frame 12. The blade holder 22 illustrated as being further displaced by a force transferred through guard 26. Relative to the neutral position of FIG. 2 and the position of FIG. 3, the blade holder 22 has pivoted to a predetermined location defined by stop 30 and stop arm 31 and has moved in a generally linear manner in a transverse direction relative to the frame 12. Thus, a second mode of articulation can thus be defined as linear articulation wherein blade holder 22 has linearly moved relative to frame 12.

In the second mode of articulation, a force generated by the collision of the guard rail 26 with an object or wall is transferred to the connecting structure 20 and the stop 30. This force is translated by the stop 30 in a direction that is opposite that of the biasing force of the return spring 32. This linkage between the guard rail 26, the connecting structure 20 and the stop 30 drives the generally transverse movement of the mounting assembly 15 and the blade holder 22. The slots 28 located on the mounting arm 17 define the range of transverse motion relative to the frame 12.

As a result of the first and second mode of articulation, the blade holder 22 can be moved or "retracted" substantially within the side boundary 40 of machine to avoid contact with a wall or other obstacle. As a further result, the surface maintenance machine 10 can be operated significantly closer to a wall structure or obstacle during a cleaning operation.

The matter set forth in the foregoing description and accompanying drawings is offered by way of illustration only and not as a limitation. While particular embodiments has been shown and described, it will be obvious to those skilled in the art that changes and modifications may be made without departing from the broader aspects of applicants' contribution. The actual scope of the protection sought is intended to be defined in the following claims when viewed in their proper perspective based on the prior art.

We claim:

1. A surface maintenance apparatus comprising:

a frame;

a moveable mount coupled to the frame; and a surface maintenance tool coupled to the mount and pivotally moved relative to the mount upon engagement with an obstacle, wherein a mount stop prevents further pivotal movement of the surface maintenance tool away from the obstacle, and wherein the mount is capable of being further displaced away from the obstacle after the surface maintenance tool engages the mount stop.

2. The apparatus of claim 1, wherein the mount includes a spring coupling the mount to the frame.

3. The apparatus of claim 1, and further comprising a guardrail coupled to the tool.

4. The apparatus of claim 1, wherein a slide joint couples the mount to the frame.

5. The apparatus of claim 1, wherein the tool includes a squeegee assembly.

6. The apparatus of claim 5, wherein the squeegee assembly includes a link, and wherein the link couples to the mount in a ball joint.

7. The apparatus of claim 6, wherein the squeegee assembly includes a connecting structure, and wherein the connecting structure couples to the link.

8. A surface maintenance apparatus comprising:

a frame;

a mount coupled to the frame, the mount movable transversally with respect to the frame, and a squeegee assembly coupled to the mount and movable relative to the mount until engagement with a mount stop, wherein the mount moves transversally after the squeegee assembly has moved into engagement with the mount stop.

9. The apparatus of claim 8, wherein the squeegee assembly pivots about the mount.

10. The apparatus of claim 9, wherein a 4 bar linkage couples the squeegee assembly to the mount.

11. A surface maintenance apparatus comprising:

a frame;

a mount coupled to the frame, the mount movable transversally with respect to the frame; and a squeegee assembly coupled to the mount and movable to a predetermined position relative to the mount, wherein the mount moves transversally after the squeegee assembly has moved to the predetermined position, and wherein the squeegee assembly is coupled to a guard rail.

12. The apparatus of claim 8, wherein a biasing element couples the mount to the frame.

13. A tool mounting assembly for a surface maintenance apparatus, the assembly comprising:

a mount which moves transversally with respect to the surface maintenance apparatus;

a tool assembly coupled to the mount and movable to a predetermined position relative to the mount; and a guard rail coupled at one end of the tool assembly, wherein the mount moves transversally after the tool assembly has moved to the predetermined position upon contact of the guard rail with an obstacle.

14. The tool mounting assembly of claim 13, wherein the tool assembly includes a squeegee assembly.

15. The tool mounting assembly of claim 14, wherein the mount includes a slide joint that couples to the surface maintenance apparatus.

16. The mounting assembly of claim 14, wherein the mount includes a biasing element that couples to the surface maintenance apparatus.

17. The tool mounting assembly of claim 14, wherein the squeegee assembly pivots about the mount.

* * * * *

UNITED STATES PATENT AND TRADEMARK OFFICE

CERTIFICATE OF CORRECTION

PATENT NO. : 7,059,015 B2 
APPLICATION NO. : 10/394939
DATED : June 13, 2006
INVENTOR(S) : Hamiline et al.

It is certified that error appears in the above-identified patent and that said Letters Patent is hereby corrected as shown below:

Delete Title page illustrating figure, and substitute therefor, new Title page illustrating figure. (attached)

In the drawings, Sheet 1, Fig. 1, the drawing should appear as follows:

FIG. 1

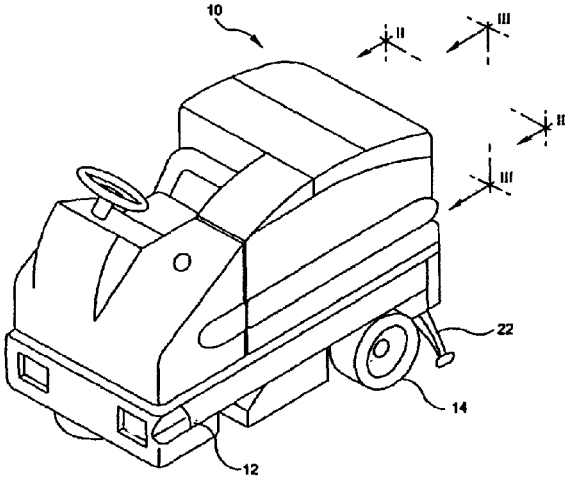

In the drawings, Sheet 2, Fig. 2, the drawing should appear as follows:

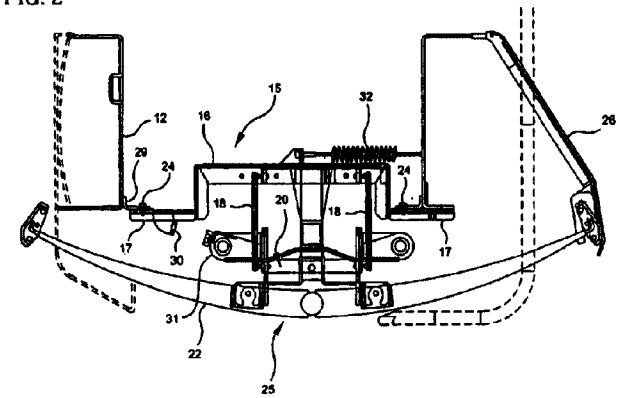

FIG. 2

UNITED STATES PATENT AND TRADEMARK OFFICE

CERTIFICATE OF CORRECTION

PATENT NO. : 7,059,015 B2 
APPLICATION NO. : 10/394939
DATED : June 13, 2006
INVENTOR(S) : Hamiline et al.

It is certified that error appears in the above-identified patent and that said Letters Patent is hereby corrected as shown below:

In the drawings, Sheet 3, Fig. 3, the drawing should appear as follows:

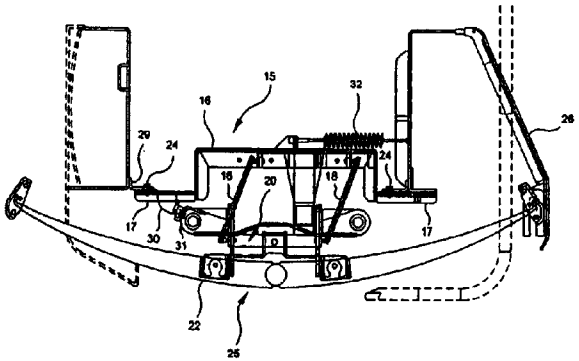

FIG. 3

In the drawings, Sheet 4, Fig. 4, the drawing should appear as follows:

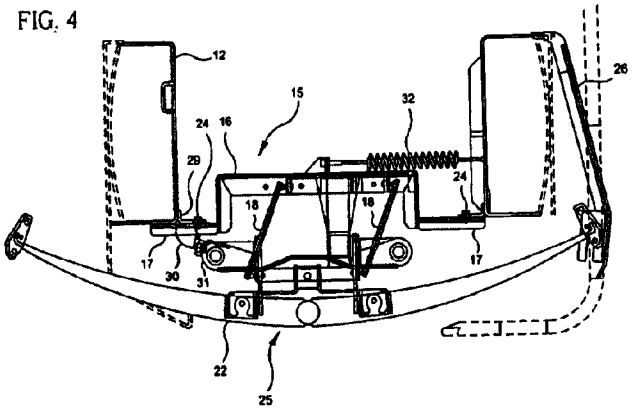

FIG. 4

UNITED STATES PATENT AND TRADEMARK OFFICE

CERTIFICATE OF CORRECTION

PATENT NO. : 7,059,015 B2 
APPLICATION NO. : 10/394939
DATED : June 13, 2006
INVENTOR(S) : Hamiline et al.

It is certified that error appears in the above-identified patent and that said Letters Patent is hereby corrected as shown below:

In the drawings, Sheet 5, Fig. 5, the drawing should appear as follows:

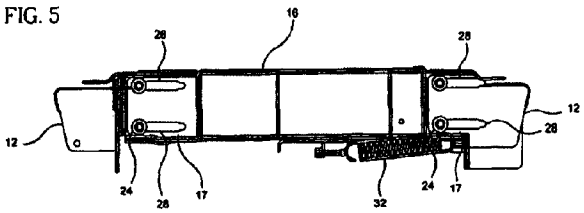

FIG. 5

UNITED STATES PATENT AND TRADEMARK OFFICE

CERTIFICATE OF CORRECTION

PATENT NO. : 7,059,015 B2
APPLICATION NO. : 10/394939
DATED : June 13, 2006
INVENTOR(S) : Hamiline et al.

It is certified that error appears in the above-identified patent and that said Letters Patent is hereby corrected as shown below:

In the drawings, Sheet 5, Fig. 6, the drawing should appear as follows:

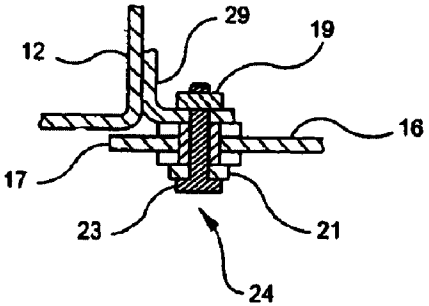

FIG. 6

Signed and Sealed this

Seventeenth Day of October, 2006

JON W. DUDAS
*Director of the United States Patent and Trademark Office*

(12) United States Patent
Hamline et al.

(10) Patent No.: US 7,059,015 B2
(45) Date of Patent: Jun. 13, 2006

(54) TOOL MOUNTING ASSEMBLY FOR A SURFACE MAINTENANCE MACHINE

(75) Inventors: Anthony John Hamline, St. Paul, MN (US); Robert Allan Geyer, Green Valley, AZ (US); Richard Allen Nelson, Big Lake, MN (US); Terence Alan Peterson, Plymouth, MN (US)

(73) Assignee: Tennant Company, Minneapolis, MN (US)

( * ) Notice: Subject to any disclaimer, the term of this patent is extended or adjusted under 35 U.S.C. 154(b) by 418 days.

(21) Appl. No.: 10/394,939

(22) Filed: Mar. 21, 2003

(65) Prior Publication Data

US 2004/0025288 A1 Feb. 12, 2004

Related U.S. Application Data

(60) Provisional application No. 60/366,486, filed on Mar. 21, 2002.

(51) Int. Cl.
*E01H 1/08* (2006.01)

(52) U.S. Cl. ..... 15/401; 15/49.1; 15/78; 15/320; 15/340.3

(58) Field of Classification Search ..... 15/49.1, 15/50.1, 78, 87, 320, 340.1, 340.2, 340.3, 15/340.4, 401; 172/38, 91, 96, 794, 816; 451/350–353
See application file for complete search history.

(56) References Cited

U.S. PATENT DOCUMENTS

| | | | | |
|---|---|---|---|---|
| 3,939,518 | A * | 2/1976 | Whitney et al. | 15/98 |
| 4,006,506 | A * | 2/1977 | Burgoon | 15/50.1 |
| 4,492,002 | A | 1/1985 | Waldhauser et al. | 15/320 |
| 5,265,300 | A | 11/1993 | O'Hara et al. | 15/49.1 |
| 5,377,382 | A * | 1/1995 | Bores et al. | 15/340.1 |
| 5,454,138 | A | 10/1995 | Mondigo et al. | 15/354 |
| 5,455,985 | A | 10/1995 | Hamline et al. | 15/401 |
| 5,623,743 | A | 4/1997 | Burgoon et al. | 15/320 |
| 6,108,859 | A | 8/2000 | Burgoon | 15/320 |
| 6,418,476 | B1 * | 7/2002 | Luciani | 709/238 |
| 6,519,808 | B1 * | 2/2003 | Legatt et al. | 15/401 |
| 6,602,018 | B1 * | 8/2003 | Feeny et al. | 403/227 |
| 2002/0073494 | A1 * | 6/2002 | Stuchlik | 15/49.1 |

FOREIGN PATENT DOCUMENTS

| | | |
|---|---|---|
| DE | 2241901 | * 3/1974 |
| EP | 1061180 | * 12/2000 |

* cited by examiner

*Primary Examiner*—Terrence R. Till
(74) *Attorney, Agent, or Firm*—Fulbright & Jaworski L.L.P.

(57) ABSTRACT

A squeegee mount and assembly which cooperate to permit both pivotal and linear motion of the squeegee assembly relative to the machine frame. To avoid contact with a stationary object, the squeegee assembly can be both pivoted and linearly moved relative to the surface maintenance machine, thereby preventing damage to the squeegee assembly and/or the surface maintenance machine. The squeegee mounting assembly includes a mounting arm, a subframe, a return spring coupled between the subframe and the frame, and a stop. A squeegee assembly comprised of a squeegee blade, an arcuate squeegee blade holder, and a link which couples the blade holder to the squeegee mounting assembly. A guard rail is also coupled to one end of the blade holder and rotatively coupled along another end to the frame.

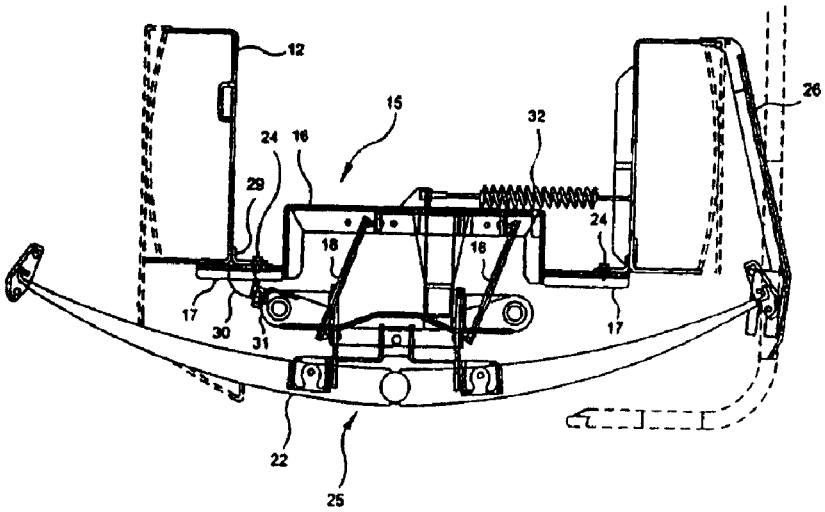

17 Claims, 5 Drawing Sheets